US006561246B2

(12) United States Patent
Yang

(10) Patent No.: US 6,561,246 B2
(45) Date of Patent: May 13, 2003

(54) LABELING MACHINE CAPABLE OF PRECISE ATTACHMENT OF A LABEL TO DIFFERENT SIZES OF CONTAINERS

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 0 days.

(21) Appl. No.: 09/768,114

(22) Filed: Jan. 23, 2001

(65) Prior Publication Data

US 2002/0096262 A1 Jul. 25, 2002

(51) Int. Cl.[7] ..... B65C 9/40; B65C 9/42

(52) U.S. Cl. ..... 156/360; 156/351; 156/362; 156/363; 156/541; 156/542

(58) Field of Search ..... 156/350, 351, 156/352, 360, 361, 362, 363, 368, 540, 541, 542

(56) References Cited

U.S. PATENT DOCUMENTS

| | | | | |
|---|---|---|---|---|
| 4,239,570 A | | 12/1980 | Kerwin | |
| 4,294,644 A | * | 10/1981 | Anderson | 156/361 |
| 4,585,506 A | * | 4/1986 | Matsuguchi | 156/361 |
| 4,620,887 A | | 11/1986 | Kontz et al. | |
| 4,647,333 A | * | 3/1987 | Voltmer et al. | 156/351 |
| RE33,579 E | | 4/1991 | Voltmer et al. | |
| 5,256,239 A | | 10/1993 | Voltmer et al. | |
| 5,269,864 A | | 12/1993 | Otruba | |
| 5,427,029 A | | 6/1995 | Dumke | |
| 5,730,816 A | | 3/1998 | Murphy | |
| 5,785,798 A | | 7/1998 | Horsman et al. | |
| 5,798,020 A | * | 8/1998 | Coughlin et al. | 156/361 |
| 5,810,955 A | * | 9/1998 | Seifert et al. | 156/362 |

* cited by examiner

*Primary Examiner*—Richard Crispino
*Assistant Examiner*—Sue A. Purvis
(74) *Attorney, Agent, or Firm*—Harness, Dickey & Pierce, P.L.C.

(57) ABSTRACT

A labeling machine includes a container conveying unit adapted to convey a container from a feed-in end to a take-out end. A container sensor is disposed adjacent to the conveying unit, and generates first and second signals upon detection of leading and trailing edges of the container, respectively. An encoder unit is associated with the conveying unit, and is operable so as to generate distance information to indicate distance advanced by the container. A label applying unit includes a label applicator plate disposed adjacent to the conveying unit. A controller activates the encoder unit upon receipt of the first signal from the container sensor, and determines the diameter of the container by inspecting the distance information from the encoder unit upon receipt of the second signal from the container sensor. The controller activates the label applying unit so as to be adapted to attach a label to the container when the label applicator plate is aligned with a central plane of the container.

1 Claim, 6 Drawing Sheets

LABELING MACHINE CAPABLE OF PRECISE ATTACHMENT OF A LABEL TO DIFFERENT SIZES OF CONTAINERS

BACKGROUND OF THE INVENTION

1. Field of the Invention

The invention relates to a labeling machine, more particularly to a labeling machine that is capable of attaching a label precisely to different sizes of containers.

2. Description of the Related Art

Commodities, such as beverage bottles, drug bottles, containers, and packaging boxes, are generally provided with a label to classify products, to indicate usage and other information, to display the trademark or logo of the manufacturer, etc. With the recent advancement in automation, automated attachment of labels to such commodities has taken the place of manual label attachment, and has become quite popular in the industry.

In a conventional label attaching process, a reel of labels is arranged on a reel supporting plate. A leading edge of the reel is drawn via a driving device to a label applicator plate where the labels are applied to containers being advanced by a container conveyer.

Although the conventional labeling machine can perform automatic label attaching, since the construction thereof is complicated, it cannot be quickly adjusted to adapt to different sizes of containers. The conventional labeling machine generally includes a sensor that generates a signal upon sensing a front end of a container being advanced by a container conveyor, and a label applicator that applies a label to the advancing container a certain period of time or a certain count of digital signals after generation of the signal by the sensor. As the label is preferably attached to the container when a vertical central plane of the container is aligned with the label applicator so that the label can be precisely attached onto the container, as illustrated in FIG. 1, if the containers to be applied with the labels differ in diameter, the labeling machine has to be adjusted so as to ensure the precise attachment of the labels to the containers. For instance, if the labeling machine that is originally used to attach labels to containers with a diameter of 30 mm is now used to attach labels to containers with a diameter of 60 mm, the labeling machine has to be accordingly adjusted so that the label applicator is precisely aligned with the central plane of each container. At present, such an adjustment is still performed manually, in combination with alteration of computer control programs according to size of the containers and rotational speed of the container conveyer, etc., and has to be conducted by technicians or engineers since ordinary workers do not possess the required skill for such complicated adjustment.

SUMMARY OF THE INVENTION

Therefore, the main object of the present invention is to provide a labeling machine capable of precise attachment of a label to different sizes of containers.

Accordingly, a labeling machine of this invention includes a motor-driven container conveying unit, a container sensor, an encoder unit, a label applying unit, and a controller. The conveying unit has a feed-in end and a take-out end. The conveying unit is adapted to convey a container from the feed-in end to the take-out end such that a leading edge of the container faces toward the take-out end and such that a trailing edge of the container faces toward the feed-in end. The trailing edge is spaced apart from the leading edge by a distance equal to a diameter of the container. The container sensor is disposed adjacent to the conveying unit between the feed-in and take-out ends. The container sensor generates a first signal upon detection of the leading edge of the container that is being conveyed by the conveying unit, and further generates a second signal upon detection of the trailing edge of the container that is being conveyed by the conveying unit. The encoder unit is associated with the conveying unit, and is operable so as to generate distance information to indicate distance advanced by the leading edge of the container from the container sensor during operation of the conveying unit. The label applying unit includes a label applicator plate disposed adjacent to the conveying unit between the container sensor and the take-out end. The controller is coupled electrically to the encoder unit, the container sensor and the label applying unit. The controller activates the encoder unit upon receipt of the first signal from the container sensor, and determines the diameter of the container that is being advanced by the conveying unit by inspecting the distance information from the encoder unit upon receipt of the second signal from the container sensor. The controller activates the label applying unit so as to be adapted to attach a label to the container being advanced by the conveying unit when the label applicator plate is aligned with a central plane of the container between the leading and trailing edges upon determination from the distance information of the encoder unit that the leading edge of the container has been displaced from the container sensor by a total distance equal to sum of a predetermined distance between the container sensor and the label applicator plate in an advancing direction of the conveying unit and one-half of the diameter of the container.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
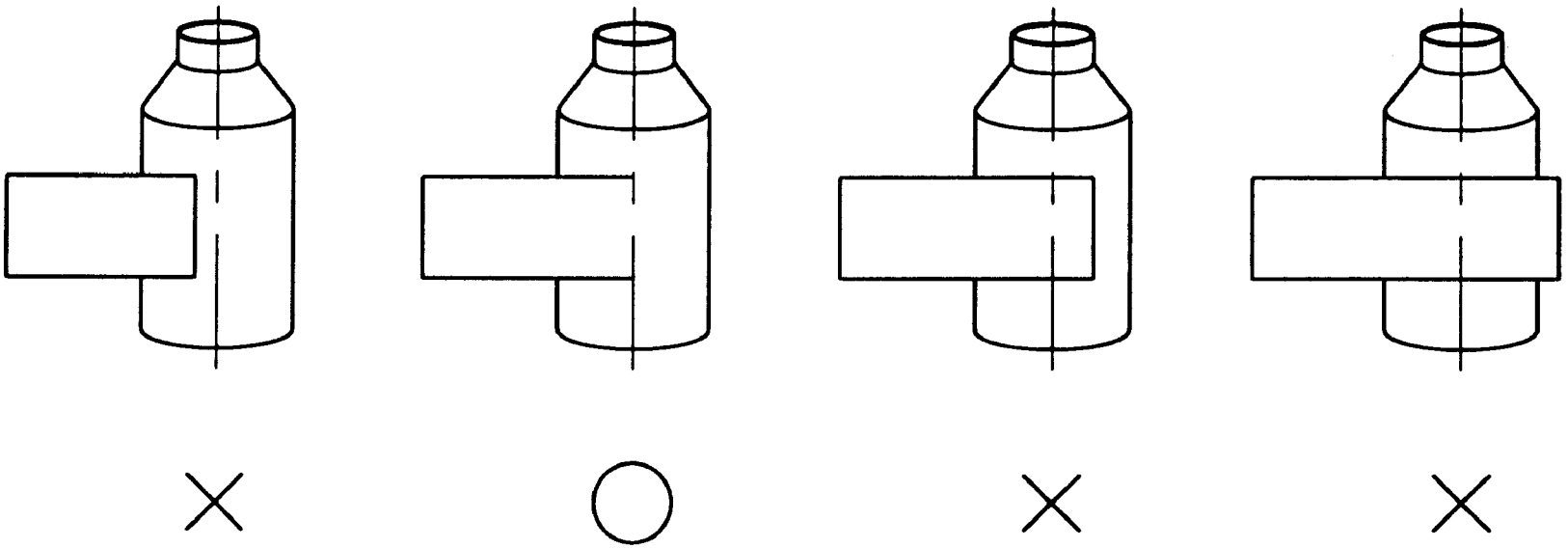
FIG. 1 is a schematic view illustrating attachment of labels to containers at different positions.
Figure 2:
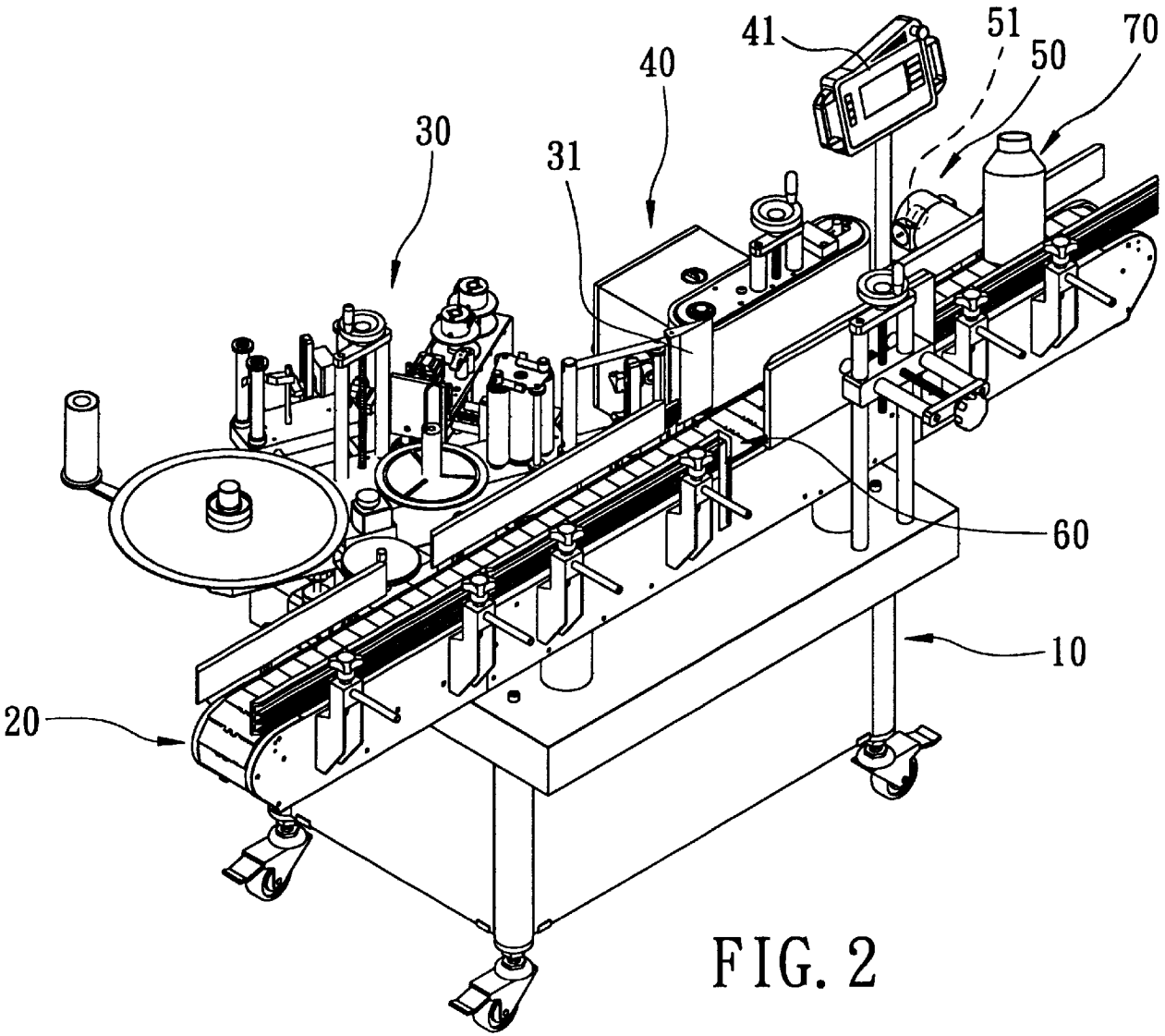
FIG. 2 is a perspective view of the preferred embodiment of a labeling machine according to the invention.

Referring to FIG. 2, the preferred embodiment of a labeling machine 10 according to the present invention is capable of precise attachment of a label to different sizes of containers. As shown, the labeling machine 10 includes a container conveying unit 20, a container sensor 60, an encoder unit 51, a label applying unit 30, and a controller 40.

The conveying unit 20 is of a known type having a feed-in end and a take-out end. The conveying unit 20 is driven by a motor 50, and is adapted to convey a container 70 from the feed-in end to the take-out end such that a leading edge 71 (see FIG. 3) of the container 70 faces toward the take-out end, and such that a trailing edge 72 (see FIG. 3) of the container 70 faces toward the feed-in end. The trailing edge 72 is spaced apart from the leading edge 71 by a distance equal to a diameter (D) of the container 70.

Figure 3:
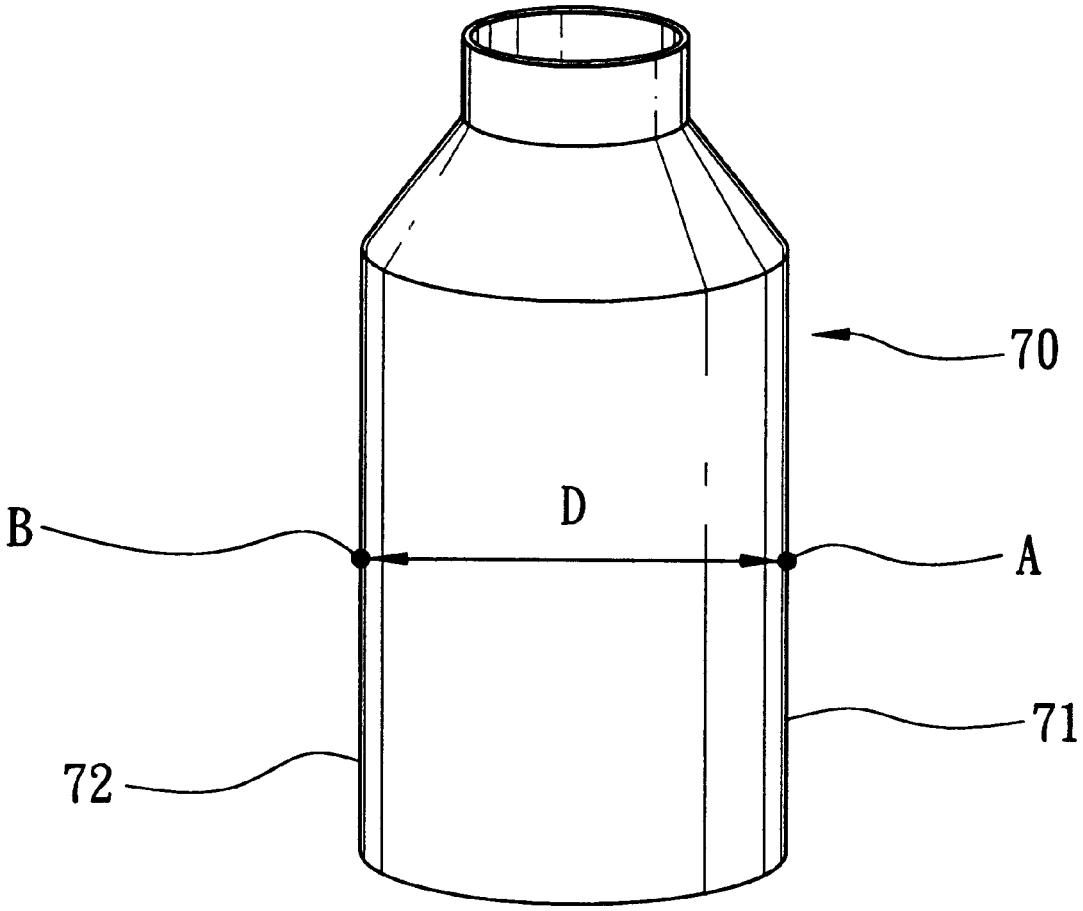
FIG. 3 is a schematic view illustrating points of generation of first and second signals by a container sensor based upon which the diameter of a container is determined according to the preferred embodiment.

Referring to FIGS. 2 and 3, the container sensor 60 such as an optical sensor, is disposed adjacent to the conveying unit 20 between the feed-in and take-out ends. The container sensor 60 generates a first signal (A) upon detection of the leading edge 71 of the container 70 that is being conveyed by the conveying unit 20, and further generates a second signal (B) upon detection of the trailing edge 72 of the container 70 that is being conveyed by the conveying unit 20.

The encoder unit 51 is associated with the conveying unit 20, and is operable so as to generate distance information to indicate distance advanced by the leading edge 71 of the container 70 from the container sensor 60 during operation of the conveying unit 20. In this embodiment, the encoder unit 51 is coupled to a main shaft (not shown) of the motor 50, and generates 1000 signals for each cycle of rotation of the main shaft. In the preferred embodiment, each signal corresponds to a distance of about 0.34 mm advanced by the conveying unit 20. Thus, information as to the distance covered by the conveying unit 20 can be obtained by the controller 40 via operation of the encoder unit 50 for subsequent conversion into a digital value.

The label applying unit 30 includes a label applicator plate 31 disposed adjacent to the conveying unit 20 between the container sensor 60 and the take-out end. As the label applying unit 30 is known in the art, and since the feature of the invention does not reside in the particular configuration of the same, a detailed description thereof will not be provided herein for the sake of brevity.

Figure 4:
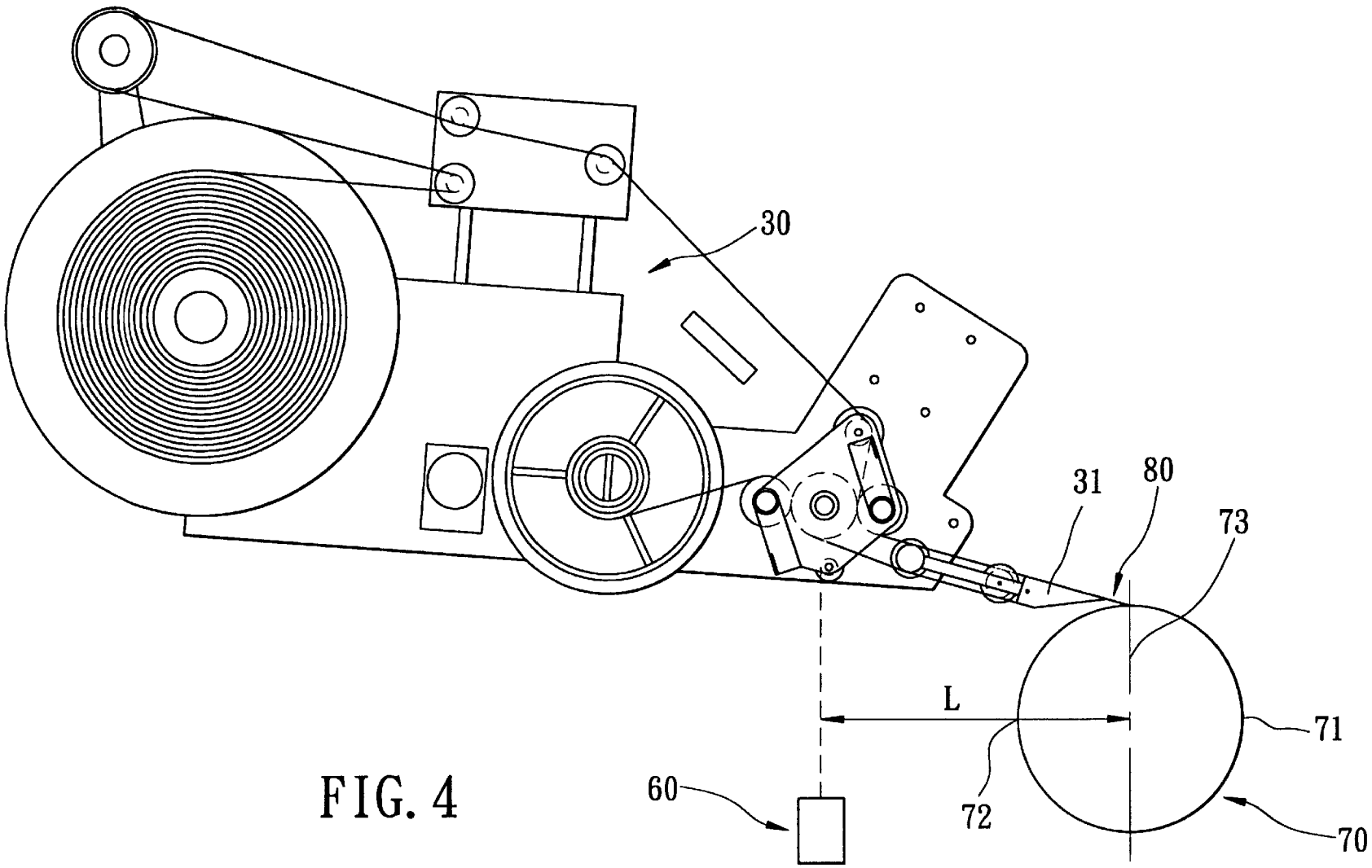
FIG. 4 is a schematic view illustrating operation of the preferred embodiment.
Figure 5:
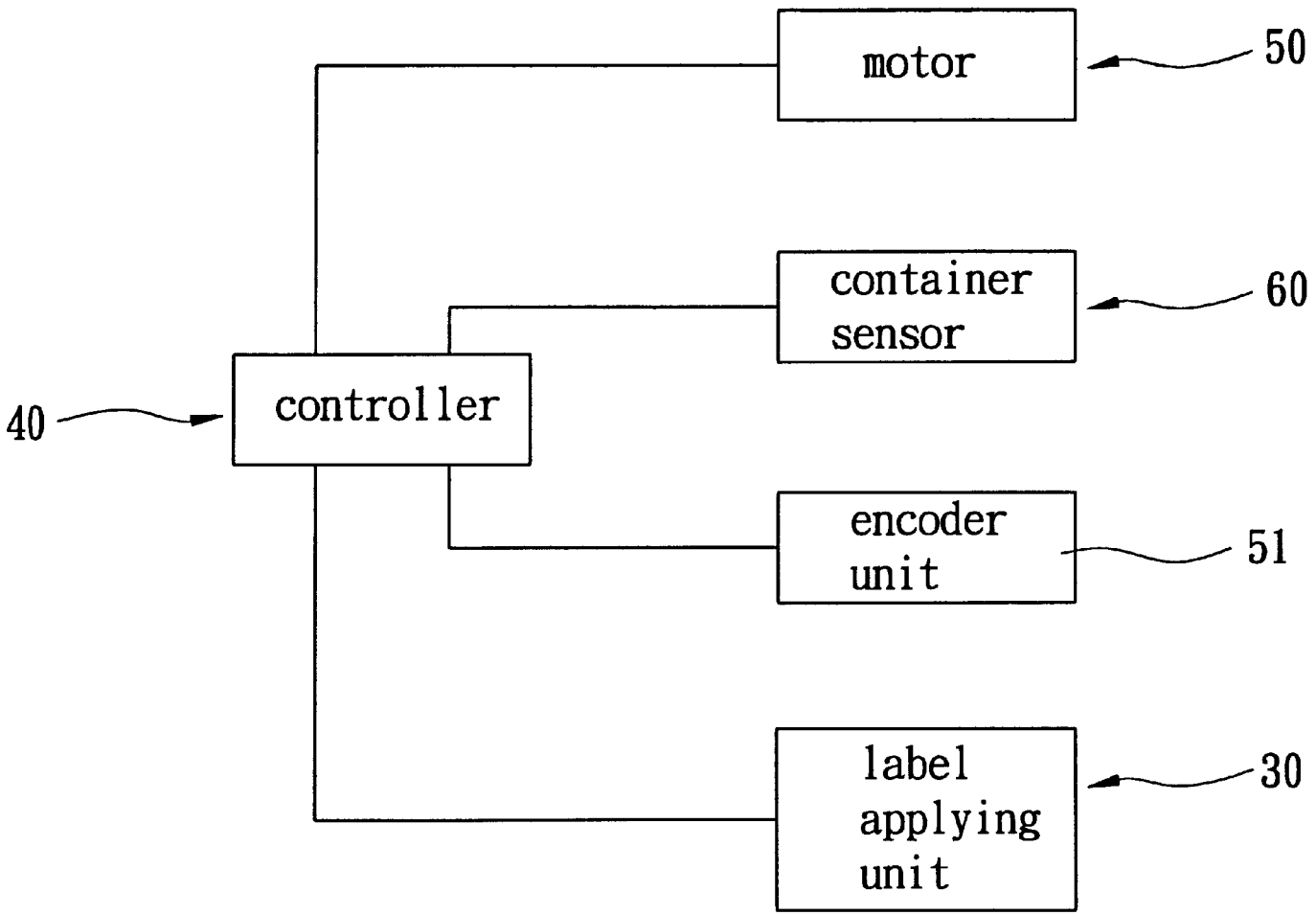
FIG. 5 is a schematic circuit block diagram of the preferred embodiment.
Figure 6:
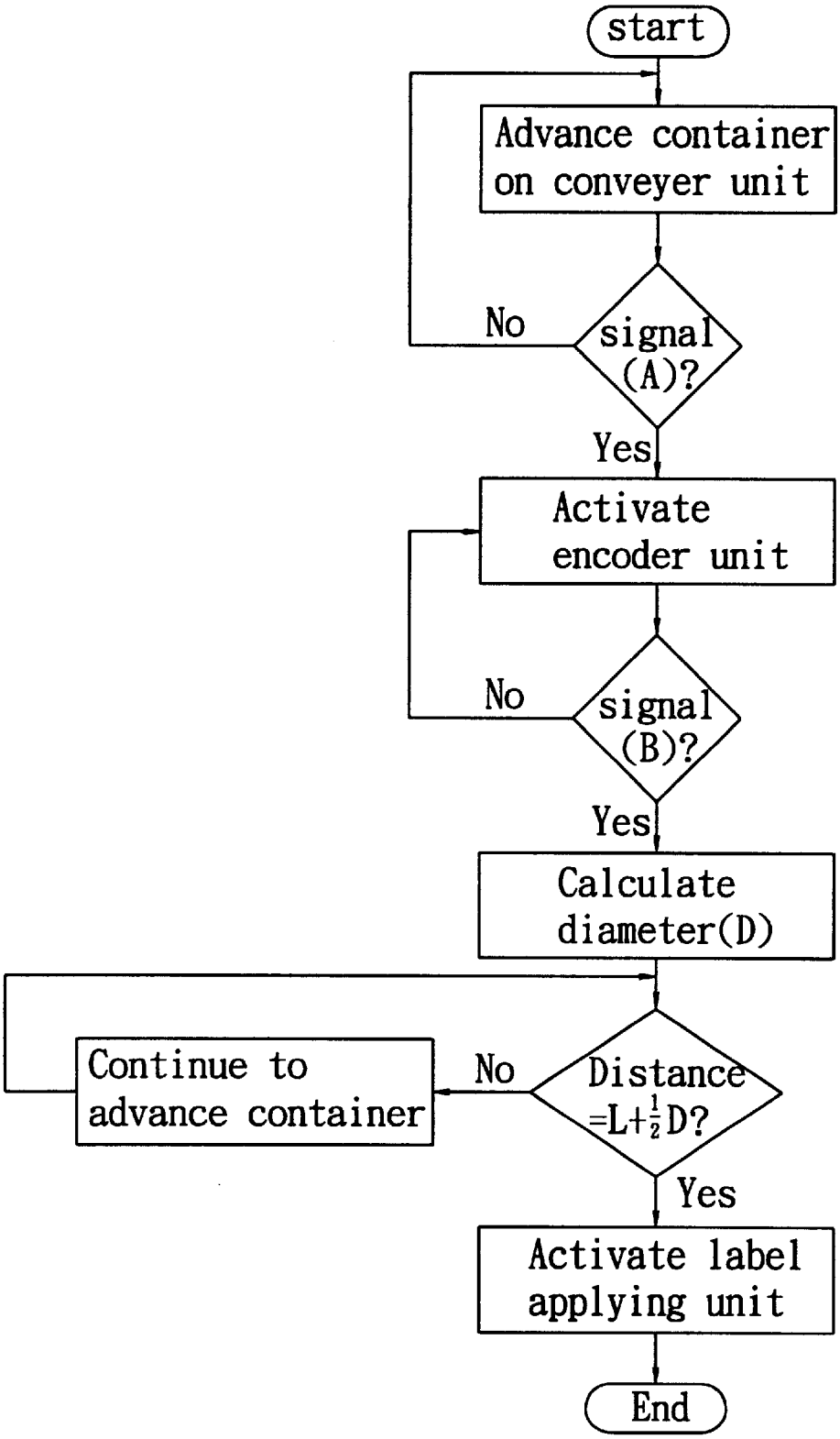
FIG. 6 is a flowchart to illustrate operation of a controller of the preferred embodiment.

With further reference to FIGS. 4 to 6, the controller 40 is coupled electrically to the motor 50, the encoder unit 51, the container sensor 60 and the label applying unit 30. The controller 40 activates the encoder unit 51 upon receipt of the first signal (A) from the container sensor 60, and determines the diameter (D) of the container 70 that is being advanced by the conveying unit 20 by inspecting the distance information from the encoder unit 51 upon receipt of the second signal (B) from the container sensor 60. The controller 40 activates the label applying unit 30 so as to be adapted to attach a label 80 to the container 70 being advanced by the conveying unit 20 when the label applicator plate 31 is aligned with a central plane 73 of the container 70 between the leading and trailing edges 71, 72 upon determination from the distance information of the encoder unit 51 that the leading edge 71 of the container 70 has been displaced from the container sensor 60 by a total distance that is equal to sum of a predetermined distance (L) between the container sensor 60 and the label applicator plate 31 in an advancing direction of the conveying unit 20 and one-half of the diameter (D) of the container 70.

The operation of the labeling machine 10 will now be described with reference to FIGS. 3 and 4, in combination with FIGS. 5 and 6. First of all, it is noted that the predetermined distance (L) is factory-set by the manufacturer instead of by the user. Supposing the predetermined distance (L) between the container sensor 60 and the label applicator plate 31 involves a digital signal consisting of 634 pulses, and the diameter (D) of the container 70 is 60 mm, the normal operation of the preferred embodiment runs as follows:

The labeling machine 10 is actuated via a control panel 41 of the controller 40. When a container 70 placed on top of the conveying unit 60 is advanced slowly thereby, the container sensor 60 will generate a first signal (A) upon detection of the leading edge 71 of the container 70 for transmission to the controller 40 so as to actuate the encoder unit 51. When the trailing edge 72 of the container 70 is detected by the container sensor 60, a second signal (B) is generated and sent to the controller 40. The controller 40 subsequently calculates the diameter (D) of the container 70 to be 60 mm, and determines a central plane 73 of the container 70, which is equivalent to one half of the diameter (D) or the radius of the container 70. At this point, the container 70 continues to be advanced toward the label applicator plate 31. After the container 70 has displaced a distance of 30 mm, which is equivalent to the radius thereof, the controller 40 will detect a count of 634 pulses, which is equivalent to the predetermined distance (L), from the encoder unit 51. At the end of the count, the container 70 has been advanced to the label applicator plate 31 such that the central plane 73 of the container 70 is just aligned with the label applicator plate 31. At this time, the controller 40 will activate the label applying unit 30 to attach a label 80 to the container 70 at a precise position via the label applicator plate 31.

It can be appreciated from the foregoing that this invention can determine the diameter of a container based upon two signals only, and can easily determine the precise time of application of a label to different sizes of containers by a total distance covered by the container from the container sensor, all of which can be done automatically and in an uncomplicated manner.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A labeling machine, comprising:

a motor-driven container conveying unit having a feed-in end and a take-out end, said conveying unit being adapted to convey a container from said feed-in end to said take-out end such that a leading edge of the container faces toward said take-out end and such that a trailing edge of the container faces toward said feed-in end, the trailing edge being spaced apart from the leading edge by a distance equal to a diameter of the container;

a container sensor disposed adjacent to said conveying unit between said feed-in and take-out ends, said container sensor generating a first signal upon detection of the leading edge of the container that is being conveyed by said conveying unit, and further generating a second signal upon detection of the trailing edge of the container that is being conveyed by said conveying unit;

an encoder unit associated with said conveying unit and operable so as to generate distance information to indicate distance advanced by the leading edge of the container from said container sensor during operation of said conveying unit;

a label applying unit including a label applicator plate disposed adjacent to said conveying unit between said container sensor and said take-out end; and a controller coupled electrically to said encoder unit, said container sensor and said label applying unit, said controller activating said encoder unit upon receipt of the first signal from said container sensor, and determining the diameter of the container that is being advanced by said conveying unit by inspecting the distance information from said encoder unit upon receipt of the second signal from said container sensor, said controller activating said label applying unit so as to be adapted to attach a label to the container being advanced by said conveying unit when said label applicator plate is aligned with a central plane of the container between the leading and trailing edges upon determination from the distance information of said encoder unit that the leading edge of the container has been displaced from said container sensor by a total distance equal to sum of a predetermined distance between said container sensor and said label applicator plate in an advancing direction of said conveying unit and one-half of the diameter of the container.

* * * * *